US005100035A

United States Patent [19]

Dunworth et al.

[11] Patent Number: 5,100,035

[45] Date of Patent: Mar. 31, 1992

[54] PERMEABLE MGO NOZZLE

[75] Inventors: Bruce Dunworth; Gary McCorkle, both of Tyler, Tex.

[73] Assignee: Ferro Corporation, Cleveland, Ohio

[21] Appl. No.: 652,462

[22] Filed: Feb. 7, 1991

Related U.S. Application Data

[63] Continuation of Ser. No. 346,397, May 1, 1989, abandoned.

[51] Int. Cl.[5] ..... B22D 00/00

[52] U.S. Cl. ..... 222/603; 164/415; 164/437

[58] Field of Search ..... 164/415, 337, 437, 475; 222/591, 603

[56] References Cited

U.S. PATENT DOCUMENTS

| | | | |
|---|---|---|---|
| 4,360,190 | 11/1982 | Ato | 266/220 |
| 4,429,816 | 2/1984 | Thrower | 164/415 |
| 4,579,165 | 4/1986 | Kamei et al. | 164/415 |
| 4,588,112 | 5/1986 | Kondo | 164/437 |
| 4,746,038 | 3/1988 | Ohwada et al. | 164/437 |
| 4,779,775 | 10/1988 | Kimura et al. | 164/437 |

FOREIGN PATENT DOCUMENTS

| | | | |
|---|---|---|---|
| 293830 | 12/1988 | European Pat. Off. | 164/437 |
| 199550 | 12/1982 | Japan | 222/591 |
| 45066 | 3/1984 | Japan | 164/437 |
| 206548 | 9/1986 | Japan | 164/415 |
| 8402670 | 7/1984 | World Int. Prop. O. | 164/415 |
| 8404893 | 12/1984 | World Int. Prop. O. | 164/415 |

*Primary Examiner*—Richard K. Siedel

*Attorney, Agent, or Firm*—D. Peter Hochberg; Mark Kusner; Louis J. Weisz

[57] ABSTRACT

An immersion nozzle for containuous metal casting having an elongated nozzle body formed from a porous, gas permeable refractory material. The nozzle body has a conduit extending longitudinally therethrough and an inner surface which defines the conduit. The nozzle body also includes an outer surface defining a predetermined body profile and channels formed in the outer surface of the nozzle body. A metallic housing encases the nozzle body and has an inner surface dimensioned to substantially conform to the profile of the nozzle body. The housing is secured to the nozzle body by a refractory mortar which forms a rigid, relative air-tight layer between the housing and the nozzle body, wherein the channel means form internal passages in the nozzle. A port is provided on the housing in registry with the channels in the nozzle body. The port is connectable to a source of inert gas, which is operable to force the gas into the passages and into the porous refractory material.

7 Claims, 3 Drawing Sheets

PERMEABLE MGO NOZZLE

This is a continuation of co-pending application Ser. No. 346,397 filed on May 1, 1989 now abandoned.

FIELD OF THE INVENTION

The present invention relates to components for foundry and steel mill applications, and more particularly to submerged nozzles typically found in ladles and tundishes used for teeming molten metals.

BACKGROUND OF THE INVENTION

Ladles and tundishes used for teeming molten steel require an outlet or outlets at the bottom thereof to direct the flow of the molten metal into a subsequent stage, e.g. a tundish, inner mold, or continuous casting molds. These outlets are typically formed by special nozzles made of refractory material having good corrosion resistance. Control of the casting rates of the molten metal is generally carried out by means of either a stopper rod assembly or a slide gate system, both of which include similar refractory material. Conventional nozzles are typically alumina-silica, chrome-alumina, alumina-graphite or zirconia-graphite refractories. A problem with such materials is that they have an affinity for impurities in steel, especially in aluminum killed steels. In this respect, deposits are apt to chemically and/or mechanically attach to the inner bore surface of the nozzles and form deposits thereon. These deposits build-up to a point where they restrict flow, and sometimes block the orifice to such a degree that flow stops.

In an attempt to solve the blockage problems created by deposit build-ups, it has been known to use porous, gas permeable nozzles to introduce an inert gas into the bore. Permeable nozzles known heretofore generally include a refractory and a metal jacket or housing spaced therefrom, wherein an air space or manifold is defined therebetween. Gas is introduced into the space or manifold through a fitting in the metal jacket. Pressure builds up between the refractory and the jacket, until it reaches a pressure sufficient to overcome the resistance inherent in the permeable refractory, at which point the inert gas flows through the refractory into the nozzle bore. Ideally, the introduction of the inert gas creates a gas film along the inner surface of the bore to retard deposit build-up. (An additional advantage of using inert gas is that it creates a positive pressure which prevents introduction of air into the molten metal. This prevents oxidation of the metal.) However, these devices are not capable of directing greater gas flow to specific locations in the bore where the build-up of deposits is most prevelant. Moreover, while maintaining an inert gas film on the bore of the nozzle increases nozzle life by retarding the build-up of deposits thereon, it does not completely eliminate the chemical and/or mechanical attraction between conventional nozzle refractory material and the impurities in the molten steel. In this respect, most conventional nozzles are alumina-silica based and have a strong affinity for impurities found in steel. Other materials, such as magnesium oxide (MgO), which is known to have no affinity for alumina, has found little acceptance or use in the manufacture of nozzles. With respect to magnesium oxide (MgO), its disfavor may be due to a perceived tendency to cracking.

In any event, the chemical attraction between impurities in molten steel and material found in conventional nozzles, together with the physical shape of the nozzle orifice (which may include areas or shapes which facilitate deposit build-up) tend to limit nozzle life.

The present invention overcomes these and other problems and provides a nozzle for teeming molten steel having a substantially reduced affinity for alumina and other impurities within the molten metal, which nozzle is porous and has a high degree of gas permeability and which provides greater gas flow to specific areas within the nozzle.

SUMMARY OF THE INVENTION

In accordance with a preferred embodiment of the present invention there is provided an immersion nozzle for continuous metal casting which includes an elongated nozzle body formed from a porous, gas permeable refractory material. The nozzle body has a conduit extending longitudinally therethrough and an inner surface which defines the conduit. The nozzle body also includes an outer surface defining a predetermined body profile, and channel means formed along the nozzle body. A metallic housing encases the nozzle body. The housing has an inner surface dimensioned to substantially conform to the profile of the nozzle body. Means for securing the housing to the nozzle body are provided, which means for securing forms a rigid, relatively air-tight layer between the housing and the nozzle body, wherein the channel means form internal passages within the nozzle. Port means are provided on the housing in registry with the channel means in the nozzle body. The port means are connectable to a source of inert gas, which is operable to force the gas into the passages and into said porous refractory material.

More specifically, the elongated nozzle body is preferably formed of a mixture of magnesium oxide (MgO) particles of several different grain sizes, wherein the nozzle body has a "fine open porosity". Fine open porosity meaning that the passages or interstices between the magnesium oxide (MgO) particles are relatively small such that inert gas passing through the nozzle body provides a uniform layer of microscopic gas bubbles along the inner surface of the nozzle bore. The fine porosity also requires a greater back pressure to force the inert gas through the small passages and interstices between the magnesium oxide (MgO) particles. It is believed that this relatively-high back pressure also assists in maintaining a uniform, relatively thick layer of inert gas along the inner surface of the nozzle bore thereby deterring contact between the molten metal and the conduit surface. This uniform layer of inert gas, together with the use of magnesium oxide (MgO) which has no affinity for alumina build-up and is generally mere inert to other impurities and alloying agents found in molten steel, produces an immersion nozzle which is less susceptible to deposit build-up along the inner surface thereof.

Importantly, the present invention provides means for directing the flow of the inert gas into the nozzle bore or conduit to areas in which impurity build-up would be most severe. In this respect, channel means comprised of annular channels or grooves are formed in the outer surface of the nozzle body. Each channel is preferably located adjacent a site within the nozzle bore where impurity build-up is most severe, thereby providing a pressurized source of inert gas immediately adjacent a bore site susceptible to deposit build-ups. It has been found that with such an arrangement, increased flow of the inert gas occurs through the nozzle wall adjacent the channel. Thus, with the present invention, increased flow of the inert gas may be directed to specific locations within the nozzle bore by selective positioning of the channels along the outer surface of the nozzle body.

Also important to the above-mentioned aspects of the present invention is that unlike permeable nozzles known heretofore which typically included a space (i.e. manifold) between the refractory nozzle body and the metal housing or jacket, the metal housing of the present invention is secured directly to the nozzle body. This direct attachment provides several advantages. First, the housing acts as a barrier or seal to prevent the inert gas from escaping outside the surface of the nozzle body, thereby confining and directing the gas flow through the wall of the refractory nozzle toward the conduit therein. Second, the housing serves as a reinforcing sleeve to hold the refractory nozzle body together, preventing the opening of any thermal-shock cracks which would allow steel to penetrate into the nozzle. The present invention therefore allows the use of materials such magnesium oxide (MgO) which have a tendency, or perceived tendency, for cracking. Third, the direct housing-to-refractory nozzle arrangement facilitates the increased back-pressure requirements created by the fine open nozzle porosity preferred in the present invention. Conventionally known permeable nozzles having manifold (spacing) designs would be subjected to intrinsically higher hoop stresses which can cause the manifold jacket to rupture.

It is an aspect of the present invention to provide a nozzle for ladles or tundishes used for teeming molten steel which has improved operational life over nozzles known heretofore.

Another aspect of the present invention to provide a nozzle as described above which is less susceptible to deposit build-up on the inner surface thereof.

Another aspect of the present invention is to provide a nozzle as described above wherein the nozzle has a substantially reduced affinity for alumina, impurities or alloying agents in molten steel.

A still further aspect of the present invention is to provide a nozzle as defined above wherein the nozzle is gas permeable and has a uniform and high degree of porosity.

A still further aspect of the present invention is to provide a nozzle as described above wherein inert gas flow therethrough may be directed to areas of the nozzle bore which are more susceptible to the formation of deposits thereon.

A still further aspect of the present invention is to provide a nozzle as described above wherein the nozzle is made primarily of magnesium oxide (MgO).

A still further aspect of the present invention is to provide a nozzle as described above which is less susceptible to cracking.

A still further aspect of the present invention is the provision of a method of forming a gas permeable component of magnesium oxide (MgO) for use in foundry and steel mill applications for teeming molten steel.

These and other aspects and advantages will become apparent from the following description of a preferred embodiment of the invention taken together with the accompanying drawings.

BRIEF DESCRIPTION OF THE DRAWINGS

The invention may take physical form in certain parts and arrangement of parts, an embodiment of which is described in detail in the specification and illustrated in the accompanying drawings wherein.

DETAILED DESCRIPTION OF A PREFERRED EMBODIMENT

Figure 1:
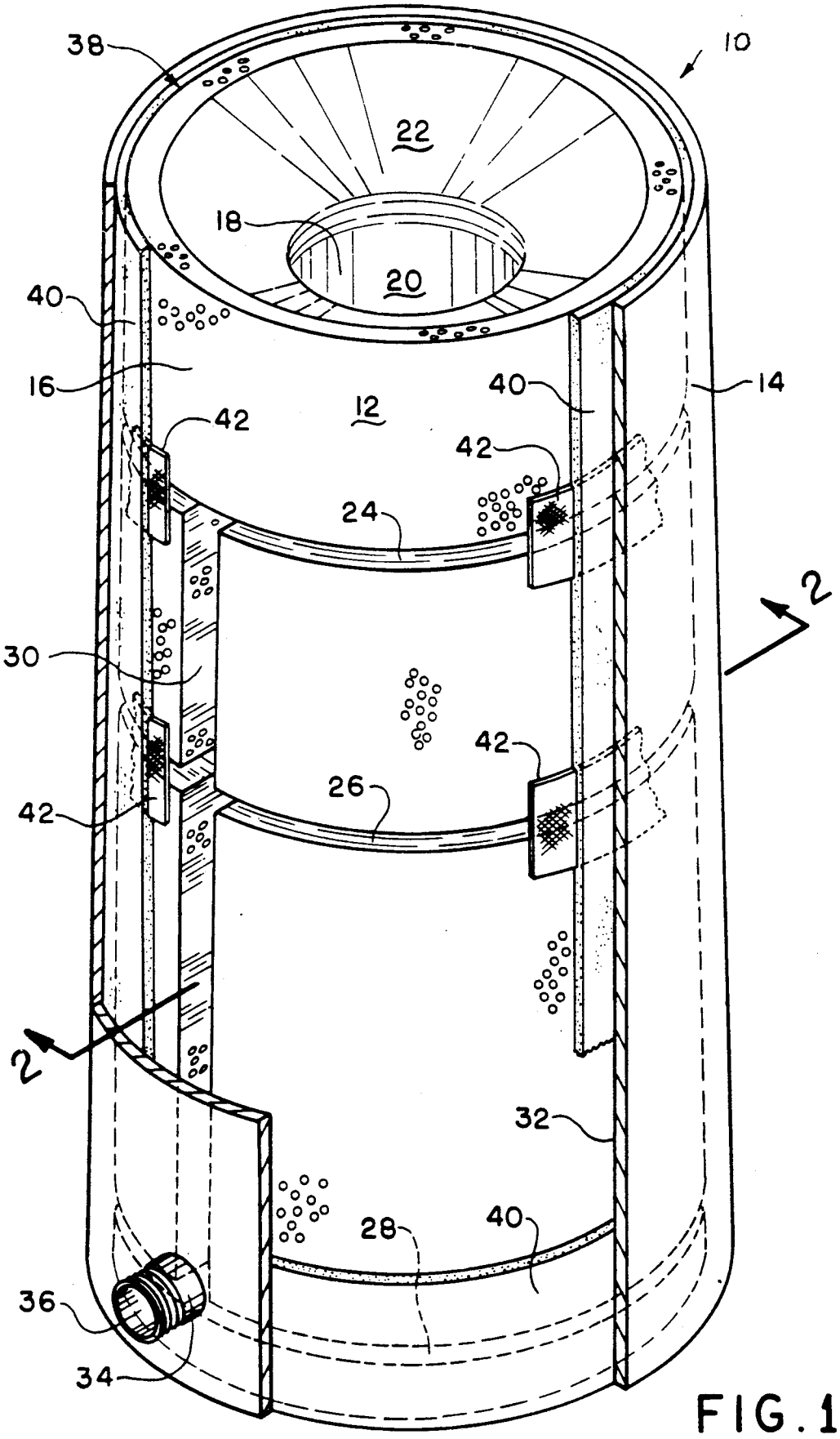
FIG. 1 is a partially-sectioned, perspective view of a permeable tundish nozzle illustrating an embodiment of the present invention.
Figure 2:
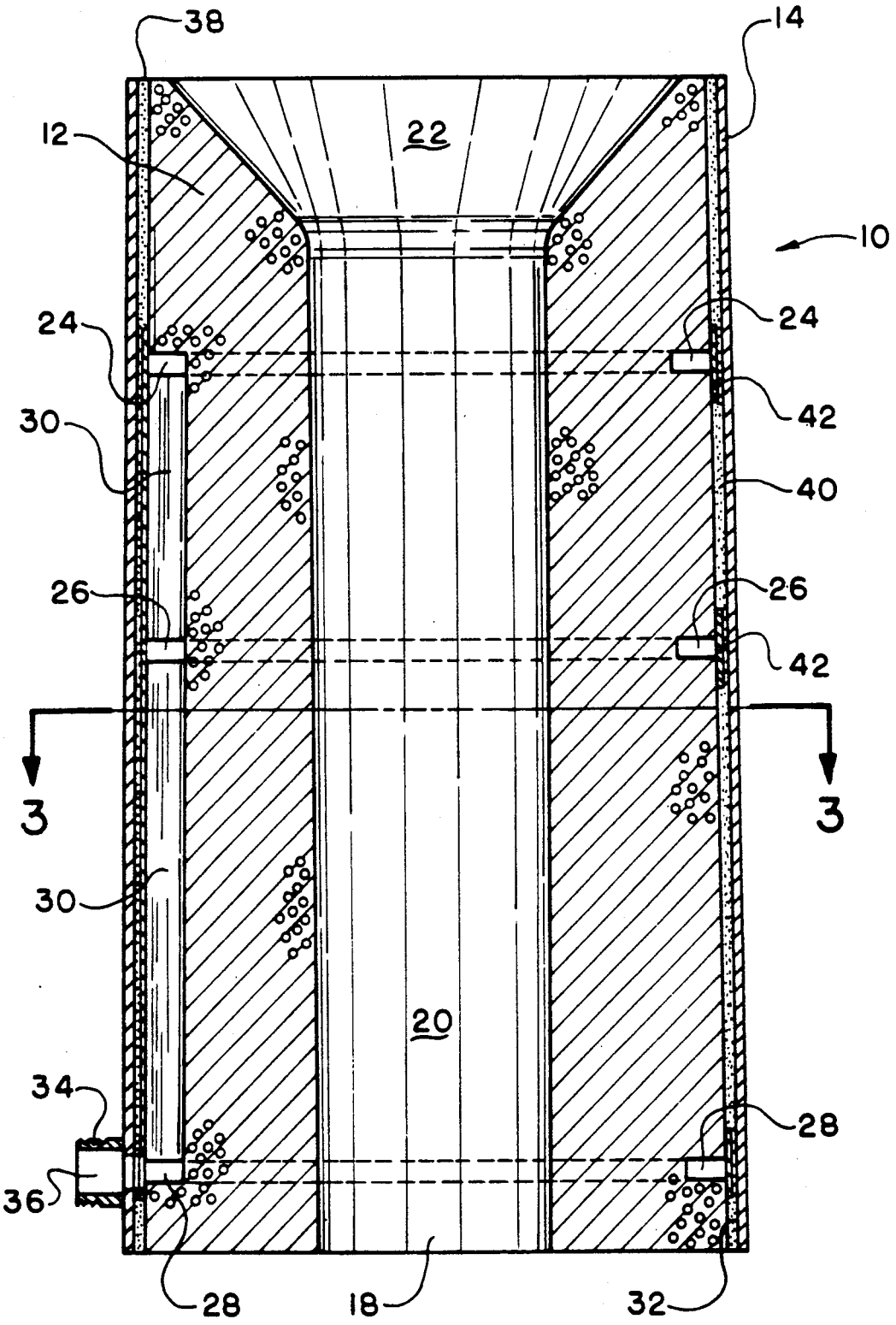
FIG. 2 is a sectional view taken along line 2—2 of FIG. 1.
Figure 3:
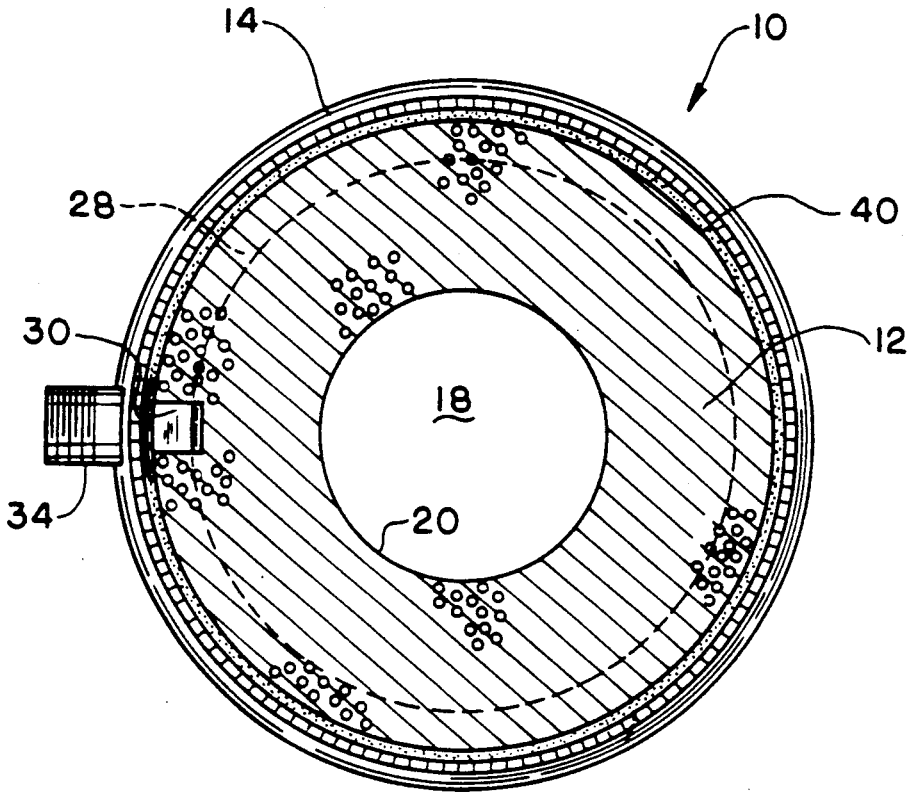
FIG. 3 is a sectional view taken along line 3—3 of FIG. 2.

Referring now to the drawings wherein the showings are for the purpose of illustrating a preferred embodiment of the invention, and not for the purpose of limiting same, FIG. 1 shows a nozzle 10 for use in a tundish for teeming molten metal. Nozzle 10 is generally comprised of a core 12 of porous refractory material surrounded by a housing 14. In the embodiment shown, core 12 is generally cylindrical in shape and has an outer surface 16 and an elongated bore or opening 18 extending longitudinally therethrough along the axis thereof. Bore or opening 18 defines an inner surface 20. As best seen in FIGS. 2 and 3, opening 18 is generally cylindrical in shape and includes a conical or flared portion 22 at the upper end of core 12. Conical portion 22 is provided to facilitate passage of the molten metal through opening 18.

The outer surface 16 of core 12 is provided with a plurality of axially-spaced, annular channels or grooves 24, 26 and 28 which extend about the periphery of core 12. A slightly larger vertical channel 30 connects channels 24, 26 and 28 to each other. The position of channels 24, 26 and 28 may vary depending upon the size, configuration and function of the nozzle itself, as will be better understood from the description of the operation of the invention set forth below.

According to the present invention, core 12 is comprised of magnesium oxide (MgO) particles. However, it will be appreciated from a further reading of the specification that the present invention finds advantageous application with other porous ceramic materials, and is not limited to magnesium oxide (MgO). A chemical analysis of a nozzle according to the present invention manufactured from sea-water produced magnesium oxide (MgO) would be:

| | |
|---|---|
| MgO | 97.9% |
| CaO | 0.8% |
| $SiO_2$ | 1.2% |
| $Al_2O_3$ | 0.9% |
| $Fe_2O_3$ | 0.5% |

—the latter materials being impurities commonly found in naturally occurring magnesium oxide (MgO). The magnesium oxide (MgO) particles forming core 12 may be from naturally occurring material, or may be either fused or brine produced.

The sizing of the particles or grains used to form core 12 is fairly critical, it being desirable to provide a nozzle porous enough to allow for excellent gas flow therethrough, yet dense enough to provide excellent wear resistance. In other words, it is desirable to produce a nozzle having a fine, open porosity. To this end, nozzle core 12 is comprised of a combination of magnesium oxide (MgO) particles of several different sizes. An example of a nozzle core having sufficiently fine-sized pores and good wear resistance, yet being porous enough to provide good gas flow is as follows:

| | Particle Size | Composition % |
|---|---|---|
| Coarsest Fraction | 0.125" + U.S. 40 Mesh | 10% |
| Coarser Fraction | U.S. 40 Mesh + U.S. 50 Mesh | 20% |
| Coarse Fraction | U.S. 50 Mesh + U.S. 65 Mesh | 30% |
| Fine Fraction | U.S. 65 Mesh + U.S. 100 Mesh | 20% |
| Finer Fraction | U.S. 100 Mesh + U.S. 150 Mesh | 5% |
| Finest Fraction | U.S. 150 Mesh | 15% |
| | Total | 100% |

It will of course be understood that the present invention is not limited to the particle sizes or percentages disclosed above, and that acceptable nozzles may be produced with varying percentages of the above particle sizes. Though not specifically tested, it is believed that the following ranges of particle sizes would be acceptable to produce a satisfactory magnesium oxide (MgO) core according to the present invention;

| | Particle Size | Composition % Range |
|---|---|---|
| Coarsest Fraction | 0.125" + U.S. 40 Mesh | 0–15% |
| Coarser Fraction | U.S. 40 Mesh + U.S. 50 Mesh | 0–25% |
| Coarse Fraction | U.S. 50 Mesh + U.S. 65 Mesh | 0–40% |
| Fine Fraction | U.S. 65 Mesh + U.S. 100 Mesh | 0–25% |
| Finer Fraction | U.S. 100 Mesh + U.S. 150 Mesh | 0–10% |
| Finest Fraction | U.S. 150 Mesh | 2–20% |

The magnesium oxide (MgO) particles are thoroughly blended, then mixed with sufficient organic binder and/or water to retain a fixed shape after forming. The forming operation may be air-ramming, vibration-casting, mechanical or isostatic pressing or other means well known to those skilled in the art of refractory fabrication. The formed article is then dried or cured and subsequently fired to a temperature sufficiently high to sinter the magnesium oxide particles together to produce a strong shape. The drying and firing is also accomplished by conventionally known methods. After firing, core 12 may be machined or shaped to a desired dimension or shape. Channels 24, 26, 28 and 30 may be molded into core 12 during the forming process, but according to the preferred embodiment of the present invention, are machined into core 12 after firing.

In the embodiment shown, core 12 is 14&½ inches in length and has an outer diameter which varies from 7&3/16 inches in diameter at one end to 7&7/16 inches in diameter at the other end. Bore or opening 18 is approximately 3 inches in diameter. It will of course be appreciated that the size or shape of core 12 are not critical to the present invention which can find advantageous application in numerous and varied sizes and shapes. It being understood that the overall shape of nozzle 10 and/or core 12 is determined by the particular casting machine or system with which it is to be used. As indicated by the dimensions set forth above, core 12 is slightly conical in shape, i.e. flaring outwardly slightly from top to bottom. This shape is provided to facilitate assembly or nozzle 10 as will be described below, but is not critical to the present invention.

Housing 14 is generally cylindrical in shape and has an inner surface 32 dimensioned to closely match and conform to the outer profile of core 12. A threaded fitting 34 is provided on housing 14. An aperture 36 extends through fitting 34 and housing 14. Housing 14 and core 12 are preferably dimensioned such that a uniformed space or gap 38 of approximately 0.06 to 0.20 inches is defined therebetween. A thin, uniform layer of a cementitious refractory mortar 40 is provided in space or gap 38 to secure housing 14 to refractory core 12. A conventionally known air-drying mortar or a phosphoric-acid containing mortar may be used. Fitting 34 is positioned on housing 14 such that when housing 14 is secured to core 12, aperture 36 is aligned with one of channels 24, 26, 28 or 30. Housing 14 basically encases core 12 and together with mortar 40 structurally reinforces core 12 as will be discussed in more detail below. Housing 14 and mortar 40 also produce a seal around core 12 and over the open portion of channels 24, 26, 28 and 30. In other words, housing 14 and mortar 40 form a generally air-tight barrier over each channel as best seen in FIG. 3. In the embodiment shown, housing 14 is formed from a low carbon steel and has a uniform wall thickness of 0.05 inches. Housing 14 is 14&½ inches in length and has an outer diameter which varies from 7&½ inches on one end to 7&¾ inches on the other.

An important aspect of the present invention is the assembly of nozzle 10. In this respect, as will be appreciated from a further reading of the specification, it is important to the operation of nozzle 10 that channels 24, 26, 28 and 30 remain "open" and do not become obstructed by mortar 40 during assembly. The simplest method of assembling nozzle 12 would be to coat nozzle 12 with mortar and slide housing 14 thereover. A problem with such process, however, is that due to the relatively small gap between housing 14 and core 12, movement of housing 14 over core 12 creates a large hydraulic pressure in mortar 40 which tends to force the mortar into the channels 24, 26, 28 and 30 formed in nozzle 12. It has been found that this problem can be overcome by covering the channels with a positionally stable barrier, and more importantly, dimensioning the width of the channels such that the barrier can withstand the hydraulic pressure exerted thereon and not be forced into the channel. In this respect, it has been found that if an adhesive tape 42, such as conventionally-known duct tape, is used to cover the channels and the width of the channels is maintained less than ½ inch, that irrespective of the size of nozzle 10, housing 14 may be slid over core 12 without mortar 40 being forced into and obstructing channels 24, 26, 28 and 30 therein. In the embodiment shown, channels 24, 26, and 28 are approximately ¼ inch wide and ½ inch deep, and channel 30 is ½ inch wide and ½ inch deep. An elongated, T-shaped member (not shown) may be inserted in channel 30 as a bridging member to prevent tape 42 from being forced into channel 30. To further facilitate such assembly, core 12 and inner surface 32 of housing 14 are slightly conical, as set forth above and as best seen in FIG. 3. After the assembly is completed, and refractory mortar 40 has set, aperture 36 is cleared by machining any mortar 40 or tape 42 which would obstruct its communication with channels 24, 26, 28, and 30.

Referring now to the operation of the present invention, nozzle 10 is adapted for use in a tundish to direct the flow of molten metal to a subsequent stage of operation in a steel making process. Nozzle 10 may include flanges or other locating surfaces to facilitate assembly in the tundish in a conventionally known fashion. It being understood that present invention is not limited to a specifically shaped or sized nozzle. In this respect, it is well known that the physical dimensions and configuration of a nozzle are determined by the particular casting machine or system with which it is used. Fitting 34 is adapted to be secured to a source of inert gas in a conventionally known fashion. The inert gas flows through fitting 34 into channel 24, and into channels 26, 28 via channel 30. When the pressure of the inert gas is sufficient to overcome the resistance inherent in the impermeable magnesium oxide (MgO) core 12, gas flows through the core 12 into the nozzle opening or bore 18. The usual flow rate of the inert gas in a nozzle as described above is approximately 15 Standard Cubic Feet per Hour (SCFH) with back pressures of between 5 to 10 psi. Importantly, with the present invention, the flow of the inert gas may be directed to a specific desired site within nozzle opening 18 by locating the channels 24, 26 and 28 in the outer surface of core 12 at locations adjacent to the desired sites. In this respect, it has been found that flow of the inert gas through the nozzle wall is greater adjacent the location of a channel. Accordingly, the nozzle may be designed (i.e. the channels may be positioned on core 12) to direct the flow of the inert gas to areas in which impurity build-ups within the bore or opening 18 would be most severe. In other words, the specific location of channels 24, 26, 28 and 30 in core 12 allows for a high degree of control of the regions in opening 18 where it is desirable to have the greatest gas pressure. It has been found that while the greatest gas pressure in bore 18 is adjacent the location of the channels in core 12, an extremely uniformed distribution of the inert gas is also provided throughout opening 18 of nozzle 10 due to the fine, open porosity of the refractory core 12 heretofore described.

A nozzle according to the present invention has been shown to provide increased operational life and substantially improve the erosion resistance. Moreover, such a nozzle shows a significant improvement against the build-up of alumina, titania and/or other deposits. The remarkable characteristics of the present invention are the result of several factors. The application of magnesium oxide in forming the core provides a core having no affinity for alumina or other impurities found in steel. The excellent porosity characteristics of the core, i.e. the fine-open porosity, is believed to generate small, fine bubbles which maintain a minuscule gas gap between the molten metal and surface 20 of bore 18. The relatively high back pressure helps maintain a uniform layer of gas bubbles between the molten metal and surface of the refractory. Importantly, the ability of the disclosed nozzle to direct the greatest flow of gas to specific locations within the nozzle bore provides maximum gas flow at sites having a susceptibility to deposit build-up. Additional advantages of a nozzle according to the present invention are that the attachment of housing 14 to core 12, in addition to sealing core 12, makes the present nozzle less susceptible to catastrophic failure due to cracking. In this respect, housing 14 holds the magnesium oxide (MgO) refractory material together much like a reinforcing band, thus preventing the opening of any cracks which may be produced in the refractory material as a result of thermal shock.

The present invention has been described with respect to a preferred embodiment. It will be appreciated that modifications and alterations will occur to those skilled in the art upon a reading of the specification and the claims herein. For example, while the present invention has been described with respect to the use of magnesium oxide in forming core 12, other materials may be utilized to provide a permeable core, and would find advantageous application with other aspects of the present invention. Moreover, the present invention is not limited to the shape and size of the channels described herein. It will be appreciated that other methods of assembly of nozzle 10, which would not limit the width of the channels, could be provided without deviating from the present invention. For example, use of a metallic tape of strip over channels 24, 26, 28, and 30 would enable wider channels to be used. It is intended that all such modifications and alterations be included insofar as they come within the scope of the patent as claimed or the equivalents thereof.

Having described the invention the following is claimed:

1. An immersion nozzle for continuous metal casting including:

an elongated, generally cylindrical, gas permeable nozzle body formed essentially of magnesium oxide particles, said body having:

a conduit extending longitudinally therethrough;

an inner surface which defines said conduit;

an outer surface defining a predetermined body profile; and spaced-apart annular grooves of predetermined configuration formed in the outer surface of said nozzle body, said grooves disposed at predetermined positions on said nozzle body;

a metallic housing encasing a substantial portion of said nozzle body, said housing having an inner surface dimensioned to substantially conform to said profile of said nozzle body;

cementitious refractory material disposed between said housing and said nozzle body for securing said housing to said nozzle body, said refractory material forming a rigid, relatively air-tight layer between said housing and said nozzle body wherein said annular grooves form internal passages in said nozzle; and port means on said housing in registry with said annular grooves, said port means connectable to a source of inert gas to force said gas into said passages and into said porous refractory, wherein said annular grooves define annular regions of inert gas flow along said inner surface of said conduit, said regions generally corresponding to said predetermined positions.

2. A nozzle as defined in claim 1 wherein said means for securing is a cementitious refractory mortar.

3. A nozzle as defined in claim 1 wherein said nozzle body has a porosity between 20% and 30%.

4. In a gas permeable nozzle for submersion in a molten metal, said nozzle comprised of an elongated body of porous refractory material, said body having an outer surface, an inner surface and a bore extending longitudinally through said body, wherein said bore defines said inner surface, and a metal housing encasing said outer surface of said body, said nozzle adapted to be connected to a source of inert gas wherein said gas flows through said body from said outer surface to said inner surface, the improvement consisting:

said nozzle being formed essentially of magnesium oxide particles of the following sizes:

| | |
|---|---|
| 0.125" + U.S. 40 Mesh | 0–15% |
| U.S. 40 Mesh + U.S. 50 Mesh | 0–25% |
| U.S. 50 Mesh + U.S. 65 Mesh | 0–40% |
| U.S. 65 Mesh + U.S. 100 Mesh | 0–25% |
| U.S. 100 Mesh + U.S. 150 Mesh | 0–10% |
| U.S. 150 Mesh | 2–20% |

a layer of cementitious refractory material disposed between said housing and said nozzle body, said refractory material forming an airtight layer between said housing and said nozzle body, and channels formed in the outer surface of said elongated body, adjacent said layer of refractory material, said channels connectable to said source of inert gas wherein said inert gas is directed into said nozzle body to effect increase gas flow at specific locations on said inner surface of said bore.

5. An immersion nozzle for continuous metal casting comprising; an elongated, porous body of a predetermined outer configuration comprised essentially of magnesium oxide (MgO) particles, said body including an inner surface, an outer surface, and a bore extending longitudinally through said body, said bore defining said inner surface;

a thin walled metal housing having an inner surface conforming substantially to said outer configuration of said body said housing dimensioned to encase a major portion of the outer surface of said nozzle body, a layer of cementitious refractory material disposed between said housing and said nozzle body for securing said metal housing to said elongated body such that an airtight seal exists therebetween, means for connecting said nozzle to a source of inert gas, and a plurality of spaced-apart annular channels formed in the outer surface of said body between said outer surface of said body and the inner surface of said layer of refractory material, said channels operable to direct said gas through said porous body to said inner surface of said bore and to create annular region of gas flow along said inner surface of said bore.

6. An immersion nozzle as defined in claim 5 wherein said means for directing are channels formed between said outer surface of said body and the inner surface of said metal housing.

7. An immersion nozzle for continuous metal casting comprising; an elongated, porous body of a predetermined outer configuration comprised substantially of magnesium oxide (MgO) particles of the following sizes:

| | |
|---|---|
| 0.125" + U.S. 40 Mesh | 0–15% |
| U.S. 40 Mesh + U.S. 50 Mesh | 0–25% |
| U.S. 50 Mesh + U.S. 65 Mesh | 0–40% |
| U.S. 65 Mesh + U.S. 100 Mesh | 0–25% |
| U.S. 100 Mesh + U.S. 150 Mesh | 0–10% |
| U.S. 150 Mesh | 0–20% |

said body including an inner surface, an outer surface, and a bore extending longitudinally through said body, said bore defining said inner surface;

a metal housing having an inner surface conforming substantially to said outer configuration of said body, means for securing said metal housing to said elongated body such that an airtight seal exists therebetween, means for connecting said nozzle to a source of inert gas, and a plurality of channels formed in the outer surface of said body between said outer surface of said body and the inner surface of said metal housing, said channels operable to direct said gas through said porous body to said inner surface of said bore.

* * * * *